United States Patent [19]

Lind

[11] Patent Number: 4,587,457

[45] Date of Patent: May 6, 1986

[54] MULTIPLE INTENSITY LAMP CONTROLLER AND LIGHTING SYSTEM

[75] Inventor: Peter A. Lind, Afton Township, Washington County, Minn.

[73] Assignee: Minnesota Mining and Manufacturing Company, St. Paul, Minn.

[21] Appl. No.: 350,153

[22] Filed: Feb. 19, 1982

[51] Int. Cl.[4] ..... H01J 7/44; H01J 13/46; H01J 17/34; H01J 19/78; H01J 23/16; H01J 29/96

[52] U.S. Cl. ..... 315/64; 315/154; 315/158; 315/159

[58] Field of Search ..... 315/64, 82, 149, 154, 315/158, 159, 194, 199, 66, 74, 122

[56] References Cited

U.S. PATENT DOCUMENTS

| | | | |
|---|---|---|---|
| 3,177,397 | 4/1965 | Keeran | 315/83 |
| 3,244,934 | 4/1966 | Webb | 315/77 |
| 3,500,455 | 3/1970 | Ross et al. | 315/149 |
| 3,500,456 | 3/1970 | Ross | 315/149 |
| 3,639,805 | 2/1972 | Muench et al. | 315/122 |
| 3,775,639 | 11/1973 | Woodward | 315/154 |
| 3,800,185 | 3/1974 | Anton et al. | 315/153 |
| 3,885,197 | 5/1975 | Moses | 315/194 |
| 3,908,131 | 9/1975 | Anton et al. | 307/12 |
| 3,962,600 | 6/1976 | Pittman | 315/158 |
| 4,095,100 | 6/1978 | Selick | 250/206 |
| 4,160,192 | 7/1979 | McAllise | 315/194 |
| 4,293,796 | 10/1981 | McMorrow | 315/205 |

*Primary Examiner*—William L. Sikes
*Assistant Examiner*—Robert E. Wise
*Attorney, Agent, or Firm*—Donald M. Sell; James A. Smith; William D. Bauer

[57] ABSTRACT

A multiple intensity lamp controller and lighting system utilizing a multiple filament lamp having a primary filament and a secondary filament coupled in series with each other and with a power source and having a variable impedance coupled across the secondary filament. The intensity of the multiple filament lamp is made comparatively bright when the value of the variable impedance is made comparatively low. Conversely, the intensity of the multiple filament lamp is made comparatively dim when the value of the variable impedance is made comparatively high.

20 Claims, 8 Drawing Figures

MULTIPLE INTENSITY LAMP CONTROLLER AND LIGHTING SYSTEM

BACKGROUND OF THE INVENTION

Present invention relates generally to lamp controllers and lighting systems and more particularly to such controllers and lighting systems utilizing multiple intensities.

There are several common examples of multiple intensity lighting systems. Automobile headlamp systems have for many years operated on a dual intensity system. The headlamp system has a bright intensity for distant visibility and a dim intensity to protect oncoming vehicles from headlamp glare. Signalling systems which are observable in both daylight and nighttime have also used multiple intensities. It is desirable to have a brighter intensity in daylight for better visibility against a bright background. It is desirable to have a dimmer intensity in nighttime to protect from glare from the signal itself and to conserve energy since the lamp does not need to be as bright to be seen. A prime example where a multiple intensity signalling system is used is vehicular traffic intersection signals. Such traffic signals must be safely observable in bright light, yet not be obtrusive at night. Further, it is also desirable that the traffic signals not have an abrupt change in intensity. An abrupt change in intensity might be interpreted by drivers as a change in signal status.

Some multiple intensity lighting systems use multiple filament lamps in parallel. An example of this type of system is seen in U.S. Pat. No. 3,177,397, Keeran, Automatic Headlight Dimmer System, which utilizes one filament of a lamp for a high beam and a second filament of the lamp for a low beam. A switch selects between using either the high beam filament or the low beam filament. Similarly U.S. Pat. No. 3,244,934, Webb, Vehicle Signal System with Control of its Light Intensity, also uses dual filament lamps with the filaments connected in parallel. The system in Webb is designed for daylight and nighttime operation. The system utilizes filaments on multiple lamps in a series. However, to select multiple intensities, one of two parallel connected filaments is selected.

U.S. Pat. No. 4,095,100, Selick, Light Responsive Switch, discloses another means for utilizing multiple intensity lighting systems. Selick discloses a street light dimmer using an external resistance in series with a single filament lamp. The system effectively lowers the voltage across the filament. Note that in this system if the external dummy resistance fails, the lamp does not light. Further, the external dummy resistance dissipates a considerable amount of power.

Multiple intensity control systems may also vary the intensity of lamps by varying the power supplied to the lamp. This can be done by limiting the voltage applied to the filament, as with the external dummy resistance applied in Selick. U.S. Pat. No. 4,293,796, McMorrow, Traffic Light Dimming Technique and Circuitry, discloses a traffic light dimming control circuit which selects between either full-wave or half-wave power. Another means of varying the intensity of the power supplied to the lamp is the utilization of pulse width modulation of an alternating current supply to control the effective power supplied. U.S. Pat. No. 3,885,197, Moses, Light Dimmer, discloses a traffic light dimmer designed for daylight and nighttime operation with a single filament lamp. Moses uses pulse width modulation of the alternating current supply to control the dimming. The system tampers with the effective power supply delivered to the single filament lamp.

Other general light responsive traffic lamp dimming systems have been utilized to avoid the sudden shift between intensities. U.S. Pat. No. 3,500,455, Ross et al, Light Responsive Electrical Lamp Dimming Means, uses proportional dimming as a function of background illumination. The system involves dimming a single filament lamp. U.S. Pat. No. 3,500,456, Ross, Light Responsive Electrical Lamp Dimming Circuit, is similar, but also controls the intensity of a plurality of single filament lamps, also using a proportional dimming technique. U.S. Pat. No. 3,800,185, Anton et al, is similar to the Ross '455 patent, but uses a single gate control device to accomplish the dimming. U.S. Pat. No. 3,908,131, Anton et al, Control Circuit Having Load and Power Source Isolation, is similar to Anton '185, but is capable of controlling plural loads.

SUMMARY OF THE INVENTION

Several problems currently exist with existing lamp controllers and multiple intensity lighting systems. Most systems either switch between differing loads or modify the effective power supplied to the load. In either case, if the multiple intensity lamp controller fails, the lamp being controlled may well be darkened. For example, in a power supply modification controller, if the controller fails in an "open" condition, no power will be transferred through the lamp. Similarly, if the controller failed in "closed short" condition, the controller might short out the power supply and draw all power away from the lamp. In systems which utilize an external dummy resistance, an "open" failure in the dummy resistance would open a series circuit and cause the lamp to go dark. In systems which switch between differing loads, a failure to switch to either one could darken both lamps. This type of failure is severe in signalling systems, such as traffic signals, where the absence of a signal could cause a serious accident. The situation is exacerbated in a multiple intensity lamp controller which has failed only in one mode, e.g. "dim" during nighttime operation. A repairman may be sent to the field in the daylight and observe a proper "bright" indication. This makes the system difficult to diagnose and repair.

These problems are solved by the present invention. A multiple intensity lamp controller is adapted to be coupled to a multiple filament lamp having at least a primary filament and a secondary filament coupled in series with each other and to a power source. The controller has a variable impedance coupled across the secondary filament. This enables the intensity of the multiple filament lamp to be comparatively bright when the value of the variable impedance is comparatively low and allows the intensity of the multiple filament lamp to be comparatively dim when the value of the variable impedance is comparatively high. In a preferred embodiment, the variable impedance is responsive to the ambient light level. And in a still preferred embodiment, the variable impedance has a region wherein the value of the variable impedance is inversely proportional to the ambient light intensity. Also in a preferred embodiment, the variable impedance has a duty cycle determined by the proportion of time the variable impedance has a high impedance value compared to a low impedance value wherein the value of the variable impedance is effectively variable by varying the duty cycle.

The foregoing problems are also solved in a multiple intensity lighting system adapted to be coupled to a power source which has a multiple filament lamp having at least a primary filament and a secondary filament coupled in series with each other and with the power source. A variable impedance is coupled across the secondary filament. The variable impedance provides a variable impedance value. In this way the intensity of the multiple filament lamp is comparatively bright when the impedance value is comparatively low and the intensity of the multiple filament lamp is comparatively dim when the impedance value is comparatively high. In a preferred embodiment, the variable impedance is responsive to the ambient light level. And in a still preferred embodiment, the variable impedance has a region wherein the impedance value is inversely proportional to the ambient light intensity. Further, in a preferred embodiment, the variable impedance has a duty cycle determined by the proportion of time the variable impedance has a high impedance value compared to a low impedance value and wherein the impedance value is effectively variable by varying the duty cycle.

A multiple intensity lamp controller or lighting system constructed in this fashion has several desirable characteristics. Power from the power supply will either be divided across both the primary filament and the secondary filament (high resistance value), or dropped only across the primary filament (low resistance value). Power dropped across only the primary filament will result in a "bright" lamp, suggested for daylight operation. Power dropped across both the primary filament and the secondary filament results in a "dim" lamp, suggested for nighttime operation.

The preferred embodiment of the multiple intensity lamp controller lighting system operates in a system with an alternating current power supply and provides adjustable pulse width modulation to proportionately vary between bright and dim conditions similar to the manner in the Ross and Anton patents.

A multiple intensity lamp controller or lighting system of the kind described provides a "fail-safe" mode of operation. Any possible range of failure in the controller will still result in the lamp being lit. As long as the lamp itself is operable, a lit lamp will result, albeit maybe only with a bright intensity or a dim intensity. The range of failure in the controller is from an open to a short since it makes only a two point interconnection in the lamp circuit. An open failure is precisely the "dim" operation, causing current to flow through both the primary filament and the secondary filament. A short failure is precisely the "bright" operation bypassing the secondary filament and causing all of the power to be dropped across the primary filament. This type of a "fail-safe" operation is extremely important in signalling systems, especially in traffic signals. The addition of a multiple intensity lamp controller or lighting system of the type defined to an existing signalling system will not introduce a new element of possible failure, causing a blacked out lamp.

Further, system diagnosis and repair is considerably improved since failure of the multiple intensity lamp controller will still result in the lamp being lit, it follows that a lamp not being lit means that the failure is elsewhere, most probably in the lamp itself. This eliminates the problem case where a multiple intensity lamp controller has failed during dim operation (nighttime), the repairman gets a report of a light out, changes the lamp during daylight hours only to have the lamp go out again at nighttime.

Further, a multiple intensity lamp controller or lighting system of the type described is compatible with existing traffic light control systems. Some of these existing systems utilize a solid state load switch to switch the various signalling combinations. Solid state load switches need a continuous path of current draw in order to stay in a conductive state. The series connected filaments provide that path and, therefore, the solid state load switch functions well with the multiple intensity lamp controller of the present invention. A pulse width modulated system controlling just a single filament lamp, would, during a portion of the power supply waveform, completely interrupt current flow. Prior art pulse width modulated control systems of this type can create problems of operation with solid state load switches.

Still further, the multiple intensity lamp controller and lighting system of the present invention uses less power than its counterparts. Nearly all of the power dissipated is dissipated in the lamps, not in some external dummy resistance for example. This makes the system of the present invention more efficient and results in less power dissipation.

BRIEF DESCRIPTION OF THE DRAWINGS

The foregoing objects, advantages, construction, and operation of the present invention will become more readily apparent from the following description and accompanying drawings in which.

DESCRIPTION OF THE PREFERRED EMBODIMENTS

Figure 1:
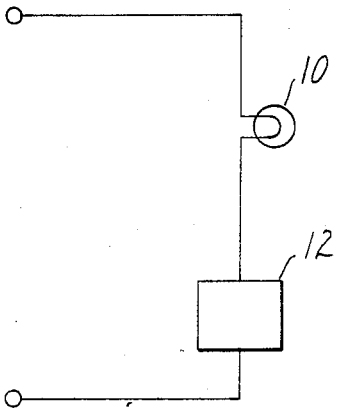
FIG. 1 PRIOR ART
FIG. 1 is a block diagram of a prior art system utilizing a dummy load.
Figure 2:
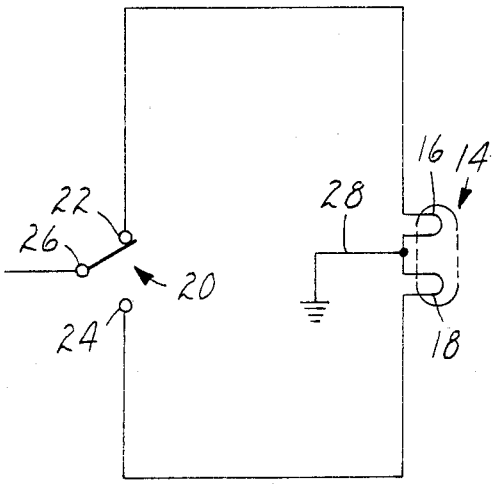
FIG. 2 PRIOR ART
FIG. 2 is a block diagram of a prior art system utilizing switched filaments.
Figure 3:
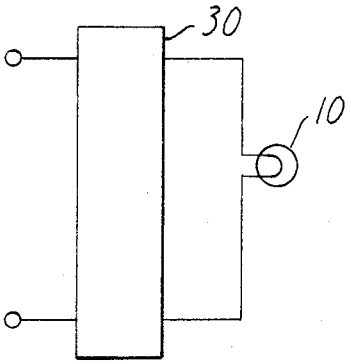
FIG. 3 PRIOR ART
FIG. 3 is a block diagram of a prior art system using a modified power supply.

FIGS. 1, 2, and 3 illustrate problems with conventional prior art multiple intensity lamp control systems.

FIG. 1 illustrates a multipe intensity lighting system having a single filament lamp 10 and a controller 12. The single filament lamp 10 and the controller 12 are coupled in series and are in turn connectable to a power supply (not shown). As the impedance through the controller 12 is varied, the effective power dissipated by the single filament lamp 10 is also varied. If the effective impedance of the controller 12 is low, single filament lamp 10 will be comparatively bright and vice versa. A multiple intensity lighting system of the type in FIG. 1 has the problem in that a failure in the controller 12 to an open condition would not allow any power flow through the single filament lamp 10 and result in a dark lamp 10 and the lack of a signal indication. This situation at a traffic signal could prove hazardous.

FIG. 2 illustrates a dual filament lamp 14 with a first filament 16 and a second filament 18. A single pole double throw switch 20 effectively couples either first filament 16 or second filament 18 into the operational circuit. First switched terminal 22 is coupled to the first filament 16 while the second switched terminal 24 is coupled to the second filament 18. The system is coupled to a power supply (not shown) from the common terminal 26 of switch 20 and at the juncture 28 of the first filament 16 and second filament 18 of the lamp 14. In some systems this point is effectively coupled to ground, for example in an automotive headlamp system. While first filament 16 and second filament 18 seem to be connected in series, the connection of juncture point 28 of the two filaments to the power supply (or to the ground side of the power supply) effectively presents a parallel circuit of first filament 16 and second circuit 18 selectively coupled to the power supply through switch 20. In the system in FIG. 2 the switch 20 effectively functions as the multiple intensity lamp controller. Note that a failure in switch 20 in switching from just one of the two switched terminals 22 and 24, would result in the loss of power to one of the two filaments 16 and 18 and corresponding darkness of the dual filament lamp 14.

The prior art multiple intensity system of FIG. 3 utilizes a single filament lamp 10 with a controller 30 coupled between the lamp 10 and the power supply (not shown). Controller 30 in this system effectively modifies the power supplied from the power supply and allows only a certain portion of that power to effectively reach the lamp 10. This may be easily done by voltage division, for example. Note that a failure in controller 30 could easily result in complete loss of power to lamp 10, again resulting in a dark lamp 10 and a complete failure in the signalling system.

Figure 4:
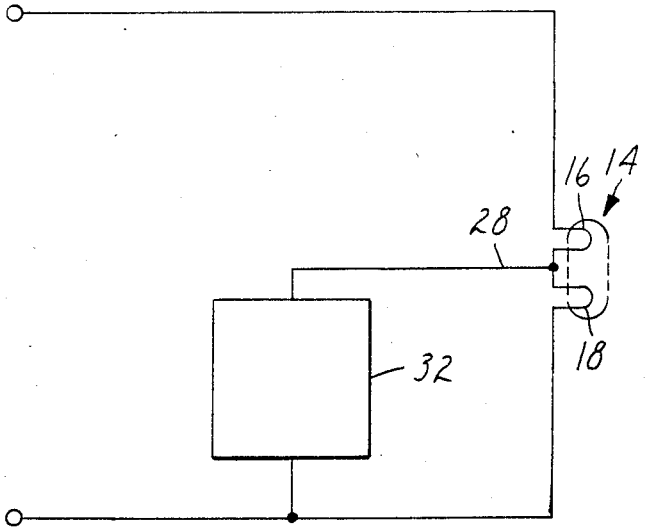
FIG. 4 is a block diagram of a multiple intensity lamp controller and lighting system of the present invention.

FIG. 4 illustrates a block diagram of the multiple intensity lamp controller and lighting system of the present invention. A dual filament lamp 14 having a first filament, or primary filament 16, and a second filament, or secondary filament 18, is directly connectable to the power supply (not shown). The multiple intensity lamp controller 32 is coupled from the juncture 28 of the primary filament 16 and the secondary filament 18 to the secondary filament 18 side of the dual filament lamp 14. The multiple intensity lamp controller 32 effectively provides a variable impedance to effectively vary the intensity of the dual filament lamp 14. The primary filament 16 and the secondary filament 18 are coupled in series with the power supply (not shown). If the effective impedance of the multipe intensity lamp controller 32 is relatively large, most of the current from the power supply will flow through both the primary filament 16 and the secondary filament 18. A voltage division effect will take place resulting in a lower voltage than is available at the power supply across each of the primary filaments 16 and the secondary filament 18. Both filaments together will produce a comparatively "dim" lamp, preferably designed for nighttime operation. When the impedance of the multiple intensity lamp controller 32 is relatively low, the current which would have passed through the secondary filament 18 will be diverted through the muliple intensity lamp controller. The impedance of the multiple intensity lamp controller being low, most of the power available from the power supply will be dissipated across the primary filament 16. Because of the larger voltage across the primary filament 16, a comparatively "bright" lamp will be observed.

Note that the multiple intensity lamp controller is connected to the lamp circuit in only two points. A failure in the multiple intensity lamp controller 32 cannot disrupt the dual filament lamp 14 from being lit. The range of failure in the multiple intensity lamp controller 32 ranges from an effective zero resistance to an effective infinite resistance. It can be recognized that the zero resistance case for the multiple intensity lamp controller is essentially the "bright" condition of the lamp 14. Similarly, it can be recognized that the infinite resistance case for the multiple intensity lamp controller 32 is precisely the "dim" condition for the lamp 14. Thus, a multiple intensity lamp controller 32 has been provided for the dual filament lamp 14 which provides for a "fail-safe" condition. As long as the dual filament lamp 14 is operational, the signalling system is operational. It is preferred that the impedance of the multiple intensity lamp controller 32 be responsive to the ambient light level in which the signalling system is located. It is also desirable that the impedance of the multiple intensity lamp controller 32 have a region wherein the value of the impedance is inversely proportional to the ambient light intensity. This will avoid the condition where an abrupt change in intensity of the dual filament lamp 14 might cause some drivers to think that a change in intensity in the signalling system was in fact a change in the signal itself.

In a simple case the impedance of the multiple intensity lamp controller 32 could be continually low when the lamp 14 is bright and continually high when the lamp 14 is dim. However, the impedance of the multiple intensity lamp controller 32 can be effectively varied by cycling the impedance between a high impedance value and a low impedance value. In this situation the proportion of time that the resistance is low compared to the time at which it is high will determine the total over-all effective impedance seen by the lamp 14. If the cycling between high and low impedance is fast enough, the human eye observing the signal produced by the lamp 14 will observe only a constant uniform effective brightness somewhere between "bright" and "dim." By varying the proportion of time in which the impedance is low or high, the proportional brightness of the lamp 14 can be controlled. The proportion of time in which the impedance of the variable intensity lamp controller 32 is either high or low is usually termed its duty cycle. Where the power source to which the lamp 14 is connected is an alternating current power source, the effective impedance of the multiple intensity lamp controller 32 can be varied by varying the impedance during a portion of a cycle of the alternating current power source or during a portion of half of the alternating current power source waveform. In this case the effective impedance of the multiple intensity lamp controller 32 can be made effectively variable in value by being at high impedance during a portion of the cycle of the alternating current power source and by being at low impedance during the remainder of the cycle of the alternating current power source.

It is, of course, recognized that the variable impedance of the multiple intensity lamp controller 32 may very well be a variable resistance. It is recognized that other variable impedances may be utilized such as variable inductance and variable capacitance.

It is also to be recognized that the stimulus for controlling the multiple intensity lamp controller 32 may come from a number of sources. It is preferred that the stimulus be the ambient light level surrounding the signalling system in which the dual filament lamp 14 is positioned. In this manner the dual filament lamp 14 can be made to be "bright" during daylight or high ambient light level and can be made to be "dim" during nighttime or a low ambient light level. However, clearly other stimulus could be used such as manual control, computer control, time of day, weather (e.g. fog) or vehicle status (e.g. braking or turning indications on a vehicle).

In general, any dual filament lamp could be utilized in the present invention as long as the proper voltages and currents are used. An example of a dual filament lamp 14 which may be utilized in connection with the present invention is a dual 150 watt filament Par 46 lamp or a dual 75 watt filament Par 46 lamp. Such a lamp has been manufactured by the General Electric Company, Cleveland, Ohio. In a preferred embodiment, these lamps are designed to be utilized with a 115 volt, 60 Hertz alternating current power system. It is to be noted that the dual filament lamp 14 itself of the type utilized in the preferred embodiment is just as reliable as its single filament counterparts that it would be replacing. Thus, the dual filament lamp 14 itself is not a source of diminished reliability.

Figure 5:
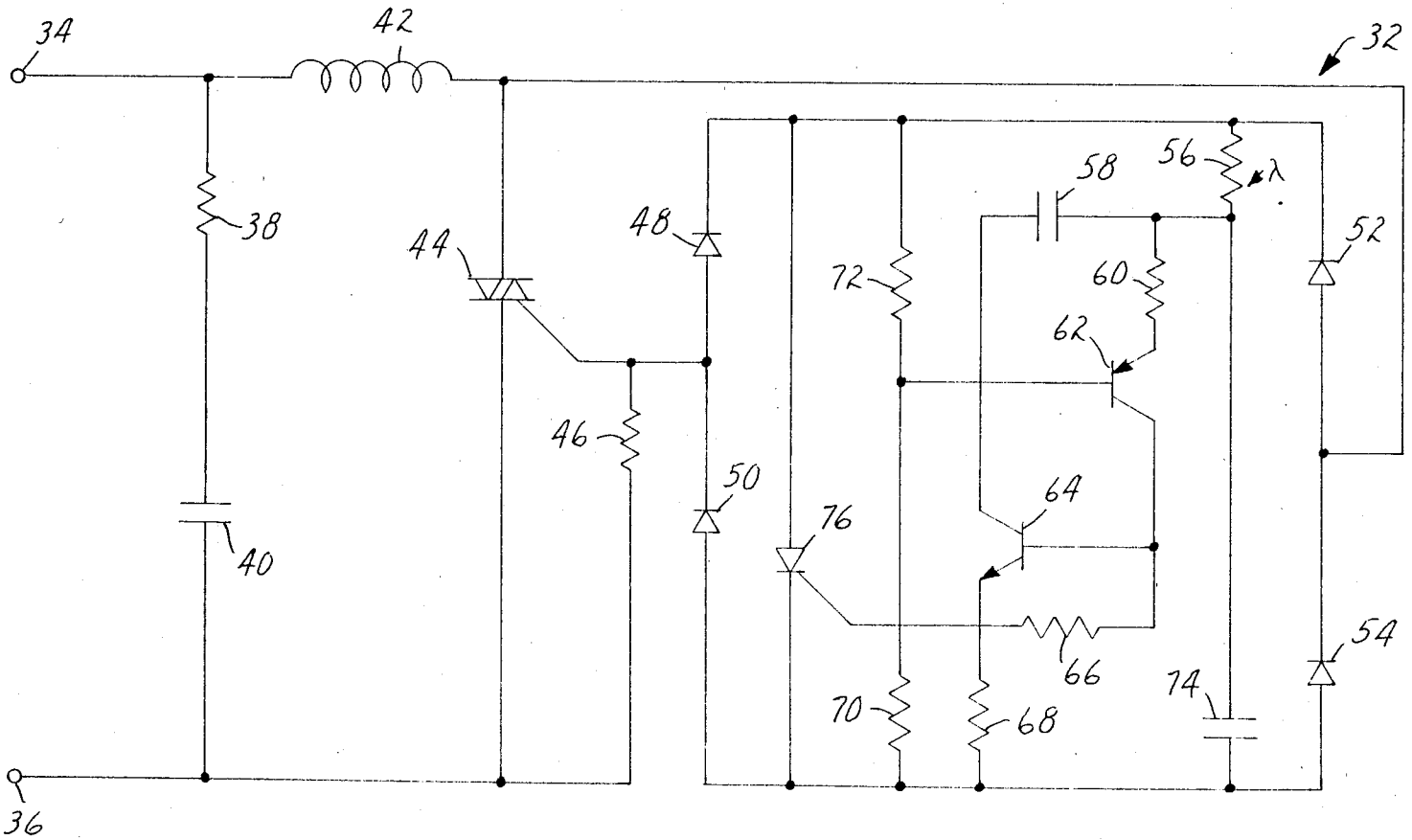
FIG. 5 is a schematic diagram of a preferred embodiment of the present invention.

FIG. 5 illustrates a schematic diagram of a preferred embodiment of the multiple intensity lamp controller 32. The circuit has terminals 34 and 36 which are connectible across the secondary filament 18 of the dual filament lamp 14. Resistor 38, capacitor 40, and inductor 42 serve to filter the power applied to the multiple intensity lamp controller 32 somewhat as well as to reduce the high frequency emissions from the multiple intensity lamp controller 32. Triac 44 is then coupled effectively across terminals 34 and 36 to effectively vary the impedance as seen from terminals 34 and 36 by having triac 44 conduct a portion of the time and nonconduct a portion of the time, or the portion of a cycle of operation. A cycle of operation could be a cycle, a half cycle, or other fraction of the alternating current power source or could be any other convenient interval, preferably short enough so that a uniform effective intensity of the lamp 14 would be observable. Diodes 48, 50, 52, and 54 provide a full wave rectifier to the circuit controlling the gate of triac 44. Variable resistor 56 is responsive to ambient light level and provides a variable resistance to trigger the rest of the control circuitry. In a preferred embodiment, variable resistor 56 varies from a 2 kilohm resistance in a bright condition to a 10 megohm resistance in a dark condition. Capacitors 58 and 74, resistor 60, PNP transistor 62, NPN transistor 64, resistors 66, 68, 70, 72, along with silicon controlled rectifier 76 complete the control circuitry to trigger triac 44 during a portion of the cycle. Preferred component values for the multiple intensity lamp controller 32 are shown in Table I.

TABLE I

| Reference Numeral | Value or Type | Part No. | Manufacturer |
|---|---|---|---|
| 38 | 30 ohms, ¼ watt, ±5% Carbon Film | | |
| 40 | 0.047 microfarad, 200 volts | C280 | Mepco |
| 42 | 200 microhenry, ±10% @ 1 kHz | | |

TABLE I-continued

| Reference Numeral | Value or Type | Part No. | Manufacturer |
|---|---|---|---|
| 44 | Triac, 6.5 amperes, 400 volts, 25 milliamperes Igt | Q4008L4 | Tecco |
| 46 | 30 ohms, ¼ watt, ±5% carbon film | | |
| 48 | Diode, 200 volt, 1 ampere | W02M | General Instrument |
| 50 | Diode, 200 volt, 1 ampere | W02M | General Instrument |
| 52 | Diode, 200 volt, 1 ampere | W02M | General Instrument |
| 54 | Diode, 200 volt, 1 ampere | W02M | General Instrument |
| 56 | Cadmium Sulfide Photocell 300 kil- @ 2 footcandles | VT833 | Valtec |
| 58 | 0.022 microfarad, 250 volt | 0.022/250 Type MR | MPC |
| 60 | 4.7 ohms, ¼ watt, ±5% carbon film | | |
| 62 | PNP Transistor | 2N3906 | |
| 64 | NPN Transistor | 2N3904 | |
| 66 | 3.3 kilohms, ¼ watt, ±5% carbon film | | |
| 68 | 4.7 kilohms, ¼ watt, ±5% carbon film | | |
| 70 | 7.5 kilohms, ¼ watt, ±5% carbon film | | |
| 72 | 330 kilohms, ¼ watt ±5% carbon film | | |
| 74 | 0.22 microfarads, 16 volts, ±10% | DITR22A35A | JEC |
| 76 | SCR, 0.8 amperes, 200 volts, 200 microamperes Igt | C103B | General Electric |

Figure 6A:
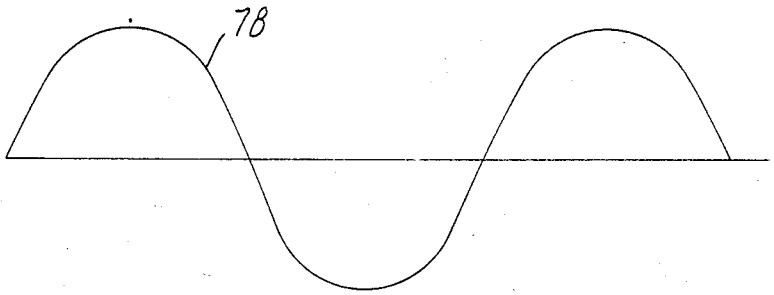
FIG. 6A is a current waveform through the secondary filament illustrating a full "dim" operation.
Figure 6B:
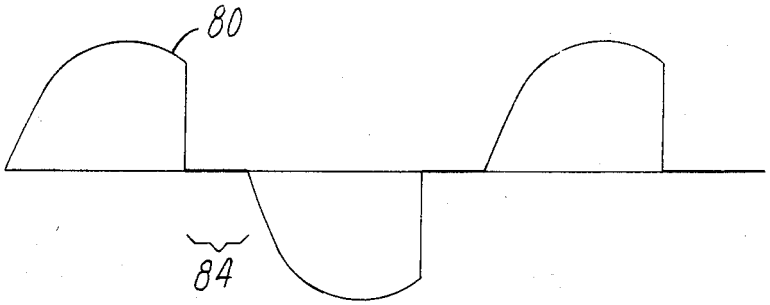
FIG. 6B is a current waveform through the secondary filament illustrating a proportionately brighter lamp.
Figure 6C:
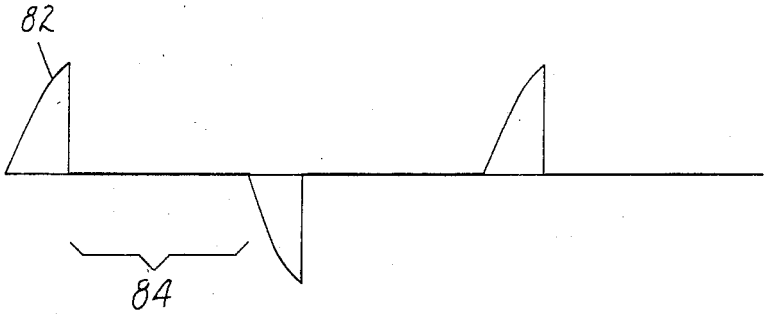
FIG. 6C is a current waveform through the secondary filament illustrating still greater bright intensity.

It is to be recognized and understood that the particular circuitry illustrated in FIG. 5 for the multiple intensity lamp controller 32 is merely preferred and indicative of a wide range of circuits which could be utilized for the same or similar purpose. The circuitry disclosed in the schematic diagram of FIG. 5 provides a proportional dimming means by varying the proportion of the time in which triac 44 conducts. Operation of the multiple intensity lamp controller 32 may be more readily understood by reference to FIGS. 6A, 6B, and 6C, which describe its operation with respect to the current flowing through secondary filament 18 when the dual filament lamp 14 is coupled to an alternating current power source. FIG. 6A waveform 78 represents the current flow through secondary filament 18 of the dual filament lamp 14 when the effective impedance value of the multiple intensity lamp controller 32 is relatively high. In this case current will flow through secondary filament 18 and power will be accordingly dissipated across it. As illustrated in FIG. 6A, the value of the impedance of the multiple intensity lamp controller 32 is high during the entire cycle of the alternating current power source. FIG. 6B, illustrated by waveform 80, illustrates the condition where the effective impedance of the multiple intensity lamp controller 32 has been lowered somewhat by causing the impedance of the multiple intensity lamp controller 32 to be low during time period 84 of each half cycle of the alternating current power source. During the time the value of the impedance of the multiple intensity lamp controller 32 is low, little or no current will flow through secondary filament 18. During time period 84 most of the voltage available from the power source will be dropped across the primary filament 16 and create a bright lamp for that time period. As the time period 84 is increased as in FIG. 6C, and waveform 82, the lamp 14 will be bright for a greater proportion of the time and the effective brightness observable will be greater.

It is to be recognized and understood that while the light sensitive element of the schematic diagram in FIG. 5 is an ambient light variable resistance, another light variable element could also be utilized. It is also to be recognized and understood that while the preferred embodiment in the schematic diagram of FIG. 5 illustrates the switching action of the multiple intensity lamp controller with a solid state switch (triac 44) that other switching means would also be operational as for example a relay. It is also to be recognized and understood that while the preferred embodiment illustrated in the schematic diagram of FIG. 5 shows the control circuitry getting its power from the actual power supplied to the dual filament lamp 14 via the full wave rectifier consisting of diodes 48, 50, 52, and 54, that other power means supplying the control circuitry are contemplated. A completely separate power supply could be utilized as well as battery operated circuitry.

It is also to be recognized and understood that while the present invention has been shown to be utilized with a dual filament lamp, that the present system would work equally well with multiple filaments having more than two filaments as long as at least two of the filaments are series connected and the multiple intensity lamp controller can be coupled across less than all of them.

Thus, it can be seen that there has shown and described a novel multiple intensity lamp controller and lighting system. It is to be understood, however, that various changes, modifications, and substitutions in the form and the details of described apparatus can be made by those skilled in the art without departing from the scope of the invention as defined by the following claims.

What is claimed is:

1. A multiple intensity lamp controller adapted to be coupled to a multiple filament lamp having at least a primary filament and a secondary filament coupled in series with each of other and to a power source, comprising a variable impedance coupled across said secondary filament wherein the intensity of said multiple filament lamp is comparatively bright when the valve of said variable impedance is comparatively low and wherein the intensity of said multiple filament lamp is comparatively dim when the value of said variable impedance is comparatively high; whereby any range of failure in the value of said variable impedance will result in said multiple filament lamp still being lit.

2. A multiple intensity lamp controller as in claim 1 wherein said variable impedance is responsive to ambient light level.

3. A multiple intensity lamp controller as in claim 2 wherein the value of said variable impendance is comparatively low when said ambient light level is comparatively high and wherein the value of said variable impedance is comparatively high when said ambient light level is comparatively low.

4. A multiple intensity lamp controller as in claim 3 wherein said variable impedance has a region in the range of the value of said variable impedance which is inversely proportional to said ambient light intensity.

5. A multiple intensity lamp controller as in claim 4 wherein the value of said variable impedance is effectively variable by cycling the value of said variable impedance between a high impedance value and a low impedance value.

6. A multiple intensity lamp controller as in claim 5 wherein said variable impedance has a duty cycle determined by the proportion of time said variable impedance has said high impedance value compared to said low impedance value and wherein the value of said variable impedance is effectivey variable by varying said duty cycle.

7. A multiple intensity lamp controller as in claim 4 wherein said power source is an alternating current power source.

8. A multiple intensity lamp controller as in claim 7 wherein the value of said variable impedance is effectively variable in value by being a high impedance during a portion of a cycle of said alternating current power source and being a low impedance during the remainder of said cycle of said alternating current power source.

9. A multiple intensity lamp controller as in claim 8 wherein said variable impedance comprises:

a variable resistance responsive to said ambient 1ight level; and switching means responsive to said variable resistance, said switching means for selectively allowing a low impedance path across said variable impedance.

10. A multiple intensity lamp controller as in claim 9 wherein said variable impedance further comprises a filter coupled across said switching means.

11. A multiple intensity lighting system adapted to be coupled to a power source, comprising:

a multiple filament lamp having at least a primary filament and a secondary filament coupled in series with each other and with said power source; and variable impedance means coupled across said secondary filament, said varaible impedance means for providing a variable impedance value, wherein the intensity of said mulitple filament lamp is comaratively bright when said impedance value is comparatively low and wherein the intensity of said multiple filament lamp is comparatively dim when said impedance value is comparatively high.

12. A multiple intensity lighting system as in claim 11 wherein said variable impedance means is responsive to ambient light level.

13. A multiple intensity lighting system as in claim 12 wherein said impedance value is comparatively low when said ambient light level is comparatively high and wherein said impedance value is comparatively high when said ambient light level is comparatively low.

14. A multiple intensity lighting system as in claim 13 wherein said variable impedance means has a region in the range of the value of said impedance value which is inversely proportional to said ambient light intensity.

15. A multiple intensity lighting system as in claim 14 wherein said impedance value is effectively variable by cycling said impedance value between a high impedance value and a low impedance value.

16. A multiple intensity lighting system as in claim 15 wherein said variable impedance means has a duty cycle determined by the proportion of time value said variable impedance means has said high impedance value compared to said low impedance value and wherein said impedance value is effectively variable by varying said duty cycle.

17. A multiple intensity lighting system as in claim 14 wherein said power source is an alternating current power source.

18. A multiple intensity lighting system as in claim 17 wherein said impedance value is effectively variable in value by being a high impedance during a portion of a cycle of said alternating current power source and being a low impedance during the remainder of said cycle of said alternating current power source.

19. A multiple intensity lighting system as in claim 18 wherein said variable impedance means comprises:

a variable resistance responsive to said ambient light level; and switching means responsive to said variable resistance, said switching means for selectively allowing a low impedance path across said variable impedance means.

20. A multiple intensity lighting system as in claim 19 wherein said variable impedance means further comprises a filter coupled across said switching means.

* * * * *